United States Patent [19]

Ferguson et al.

[11] Patent Number: 5,016,601

[45] Date of Patent: May 21, 1991

[54] SLINGSHOT WITH ADJUSTABLE SIGHT

[76] Inventors: James C. Ferguson; Marvin C. Hanz; Galen A. Moeller, all of 423 S. Irving, San Angelo, Tex. 76903

[21] Appl. No.: 406,272

[22] Filed: Sep. 12, 1989

[51] Int. Cl.[5] ..... F41B 3/02

[52] U.S. Cl. ..... 124/20.1; 124/87

[58] Field of Search ..... 124/20 R, 20 B, 22, 124/17, 87, 88, 21, 20.1, 20.3

[56] References Cited

U.S. PATENT DOCUMENTS

| | | | |
|---|---|---|---|
| 2,625,926 | 1/1953 | Foster | 124/20 R |
| 2,995,128 | 8/1961 | Hornbostel | 124/22 |
| 3,511,221 | 5/1970 | Saunders | 124/20 R |
| 4,198,949 | 4/1980 | Cook | 124/20 R |
| 4,386,598 | 6/1983 | Blaser | 124/21 |
| 4,437,449 | 3/1984 | Attanasio | 124/22 |
| 4,593,673 | 6/1986 | Kees | 124/20 B |
| 4,784,106 | 11/1988 | Kees | 124/87 X |
| 4,805,583 | 2/1989 | Mosser | 124/17 X |

*Primary Examiner*—Peter M. Cuomo

*Attorney, Agent, or Firm*—Berman, Aisenberg & Platt

[57] ABSTRACT

A slingshot includes a hand grip and a crotch which are adjustably mounted on a shoulder engaging stock. The crotch has a sighting element which is adjustable for elevation and windage. The sighting element extends into the field of view and is flexible to allow the projectile to push it out of the way without affecting the path of the projectile.

10 Claims, 2 Drawing Sheets

SLINGSHOT WITH ADJUSTABLE SIGHT

TECHNICAL FIELD

This invention relates to the art of slingshots.

BACKGROUND ART

The art of slingshots is quite old. Known slingshots are of several types. In one type, a Y-shaped element is arranged with elastic elements attached at opposed sides of a crotch such that the bottom of the "Y" can be held in the hand of the user. In another type, the "Y" has an extension which fits over the forearm of the user to provide additional support. This additional support permits the use of stronger elastic elements and provides additional stability which assists in more accurate aiming of the projectile.

SUMMARY OF THE INVENTION

In accordance with the invention, a slingshot comprises a stock which supports a shoulder engaging element, a hand grip, and a crotch element. The locations of the hand grip and the crotch are adjustable with respect to the stock so that the slingshot can be adapted to fit a wide variety of users closely.

The crotch includes a sighting element which is adjustable for elevation and windage. A sighting element is attached to a carrier, and the carrier moves along an elongate element which is mounted to the crotch. When the slingshot is in an operative orientation, the elongate element extends in a generally vertical direction so that the movement of the carrier adjusts the position of the sighting element in elevation. The carrier also includes means for adjusting the sighting element in a direction transverse to the direction of the elongate element to adjust the windage.

In a preferred embodiment, the sighting element is a flexible strip which extends into the crotch and which can simply be pushed out of the way by the projectile as it passes through the central region of the crotch. The preferred element for adjusting windage is a screw which passes through the carrier and engages the flexible sighting element. As the screw is advanced, the sighting element is pushed away from the carrier which in turn moves it across the field of view of the user. If the screw is withdrawn, the sighting element moves in the opposite direction.

An object of this invention is to provide a slingshot having unique adjusting features.

Another object of this invention is to provide a slingshot having a unique sight mechanism which is adjustable for elevation and windage.

DETAILED DESCRIPTION OF THE PREFERRED EMBODIMENT

Figure 1:
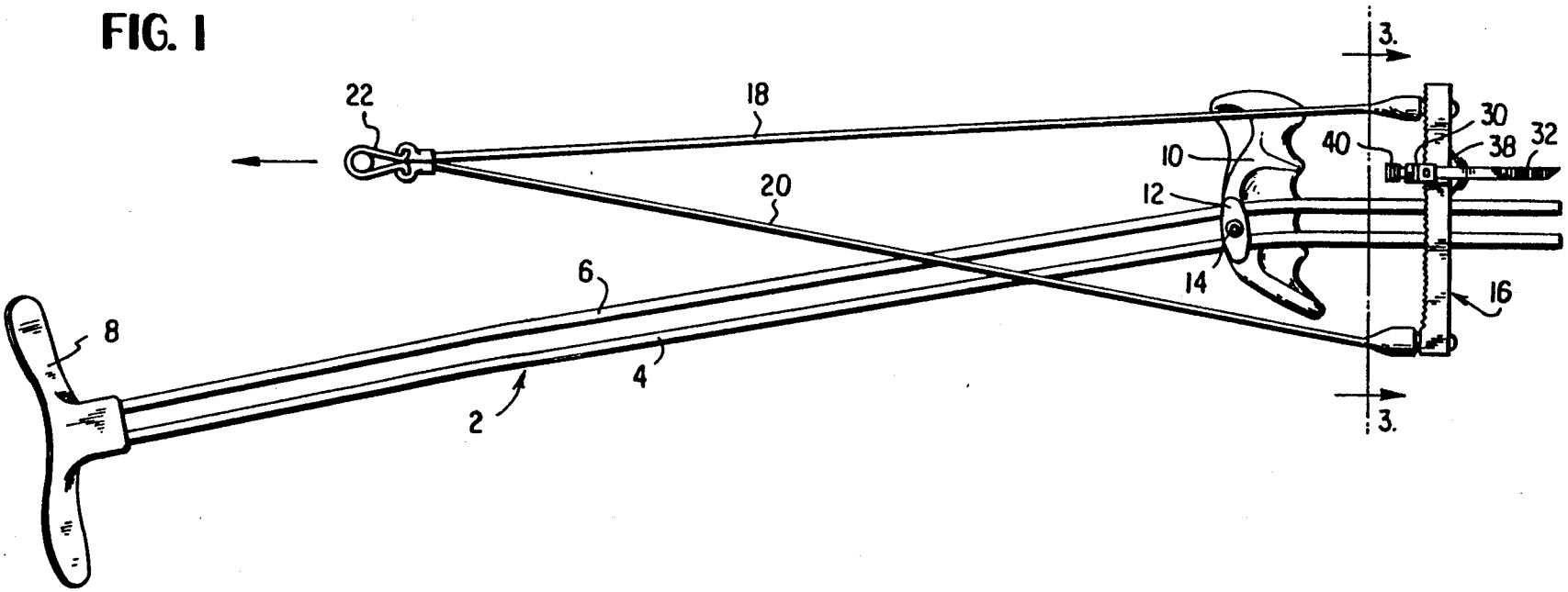
FIG. 1 is a side view of a slingshot in accordance with the invention.
Figure 2:
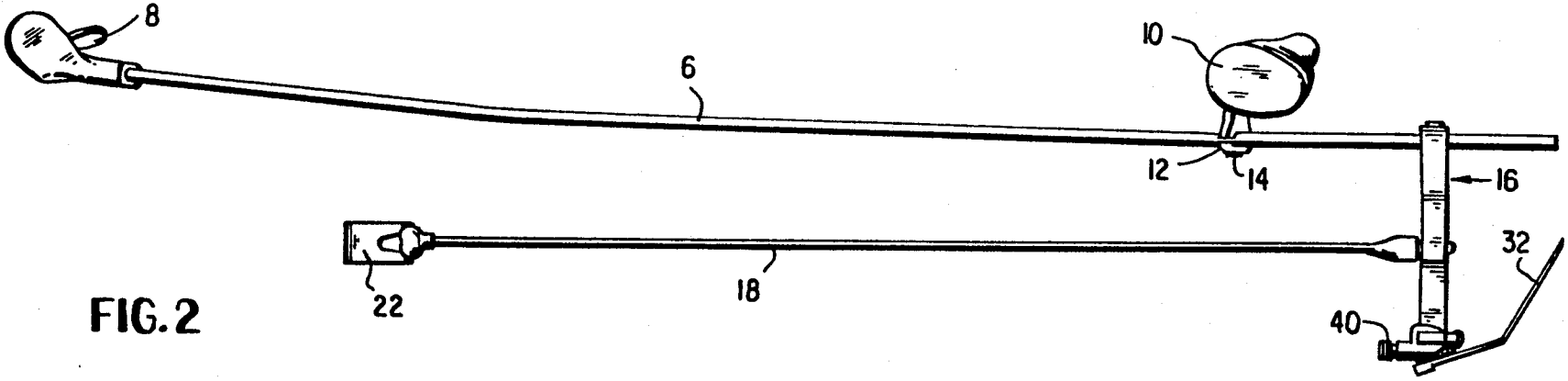
FIG. 2 is a top view of the slingshot of FIG. 1.

With reference to FIG. 1, a slingshot in accordance with the invention includes a stock 2, which is preferably made of two spaced rods 4 and 6. A shoulder engaging element 8 is attached at one end of the stock for engaging the shoulder of the user of the slingshot. A hand grip 10 is mounted to the stock by a clamp which permits adjustment of the location of the hand grip along the stock. Preferably, the adjustment for the hand grip comprises a clamping element 12 which is held to the hand grip by a screw 14. The position of the hand grip may be easily adjusted by loosening the screw 14 to release the clamp 12 and by tightening the screw after the hand grip has been located in accordance with the desires of the user. A crotch 16 is also mounted to the stock 2 in a manner which allows it to be adjusted and which will be described in more detail with respect to FIG. 3. Elastic elements 18 and 20 are attached to opposed sides of the crotch at first ends and to a holder 22 for a projectile 24 at opposite ends thereof.

Each elastic element is attached to an aligning part 42 which extends from the front of the slingshot through a respective side of the crotch. The aligning part includes a spherical portion at the front end and an elongate shaft over which the elastic element is slid at the rear end. Each side of the crotch includes a spherical recess 44 for receiving the spherical portion of the aligning part and an opening for receiving the elongate shaft. The elongate part has circumferential ridges for retaining the elastic. The ridges have 45° slopes on the rear sides and vertical slopes on the front sides to allow the elastic to be easily slid onto the shaft and yet to retain the elastic on the shafts during operation of the slingshot. The alignment provided by this structure results in greater accuracy because of automatic adjustment to the shoulder width of the user and has been found to increase the life of the elastic elements.

Figure 4:
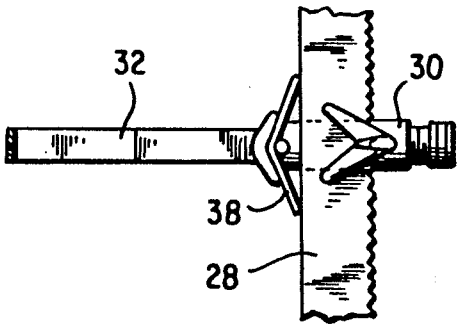
FIG. 4 is a cross section taken along line 4—4 of FIG. 3.
Figure 6:
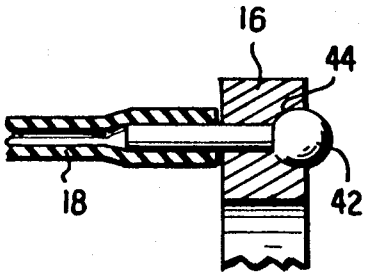
FIG. 6 is a cross section along line 6—6 of FIG. 1.
Figure 5:
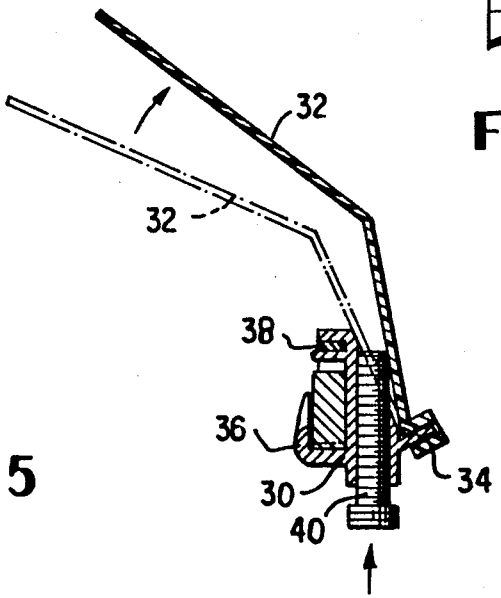
FIG. 5 is a cross section taken along line 5—5 of FIG. 3.
Figure 3:
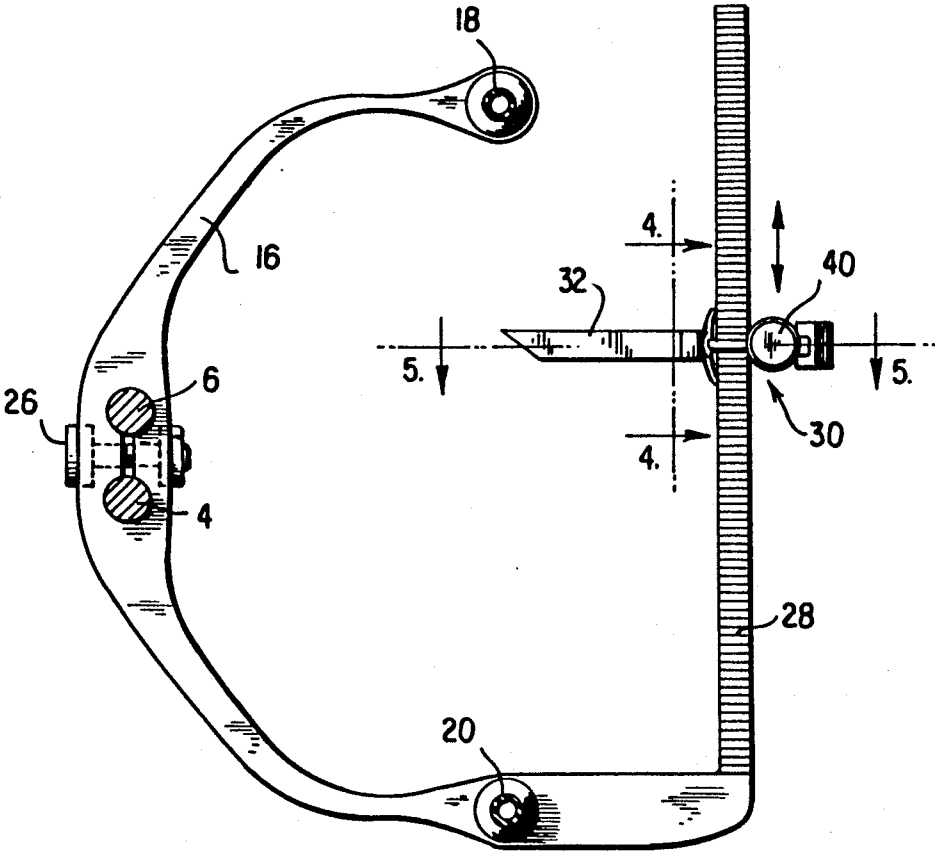
FIG. 3 is a cross section taken along line 3—3 of FIG. 1.

With reference to FIGS. 3 through 5, a crotch 16 preferably receives the rods 4 and 6 in centrally located holes and includes a screw 26 for securing the crotch to the stock by a clamping action. An elongate element 28 is mounted to the side of the crotch, preferably integrally, for supporting a carrier 30 which slides along the elongate element. A flexible sighting element 32 is attached to the carrier, for example by receiving a protrusion 34 of the carrier in a recess in an end of the flexible element. This arrangement also provides for easy replacement of the sighting element. Carrier 30 includes a hook 36 which engages two sides of the elongate element and which includes a peaked portion for engaging the serrations on the side of the elongate element. The engagement between the serrations and the peaked portion maintains a selected position of the carrier with respect to the elongate element. A transverse part of the carrier opposite from the hook 36 holds a spring 38 which engages the elongate element and urges the hook into engagement with the elongate element such that the peaked portion engages a serration. The peaked portion may be released from a serration by pushing the hook 36 away from the elongate element against the force of the spring 38. After the peaked portion is disengaged, the carrier may be moved along the elongate element to adjust the elevation of the sighting element.

Carrier 30 also has a screw 42 which passes from the front of the carrier to the rear. An end of the screw 42 engages the flexible sighting element at a location near the protrusion such that advancement of the screw in the carrier pushes the sighting element from the position shown in phantom lines in FIG. 5 to that shown in solid lines. It will be appreciated that this would have moved the tip of the sighting element to the right as viewed in FIG. 3 to adjust the windage of the sight. Retraction of the screw will have the opposite effect. The head of screw 40 may have indicia (not shown) thereon to indicate the extent of motion with respect to indicia (not shown) on the carrier.

The tip of flexible sighting element 32 extends into the field of view as seen by the operator and as essentially shown in FIG. 3. The tip, thus, lies in the area through which the projectile will pass after being released from the holder and may well be hit by the projectile. Because the sighting element 32 is flexible, it will simply be pushed out of the way by the impact of the projectile.

In operation, the sighting of the slingshot in accordance with the invention can be easily accomplished by varying the elevation and windage by moving the carrier vertically along the elongate element and by moving the tip of the sighting element horizontally by rotation of the screw 40.

Modifications within the scope of the appended claims will be apparent to those of skill in the art.

I claim:

1. A slingshot comprising a stock, shoulder engaging means attached to said stock for engaging the shoulder of a user, hand grip means attached to said stock for being engaged by the hand of said user and held in a generally vertical orientation, and crotch means attached to said stock and opening away from said stock in a generally horizontal direction for supporting resilient elements for propelling a projectile, and hand grip adjusting means for adjusting the position of said hand grip means with respect to said stock, wherein said crotch comprises adjustable sight means for being aligned with a target by said user, said adjustable sight means comprises an elongate element on the side of said crotch opposite said stock and extending in a generally vertical direction, a carrier mounted to said elongate element for movement therealong, and a sighting element carried by said carrier, wherein said sighting element extends into said crotch and comprises means for permitting it to move out of said crotch if struck by said projectile.

2. A slingshot according to claim 1 further comprising aligning means for attaching said resilient elements to said crotch, said aligning means comprising a shaft having a spherical part at a front end and means for engaging a said resilient element at a rear end and means forming a recess in said crotch for receiving said spherical part.

3. A slingshot according to claim 1 wherein said stock comprises two spaced elements and said hand grip adjusting means comprises means for clamping said hand grip means to said stock.

4. A slingshot according to claim 3 wherein said spaced elements form a gap therebetween and said hand grip adjusting means extends through said gap and engages said elements on a side of said stock remote from said hand grip means.

5. A slingshot according to claim 1 further comprising crotch adjusting means for adjusting the position of said crotch with respect to said stock.

6. A slingshot according to claim 1 wherein said sighting element extends into said crotch and is flexible to permit it to move out of said crotch if struck by said projectile.

7. A slingshot according to claim 6 wherein said sighting element comprises a flexible strip attached at one end of said carrier.

8. A slingshot according to claim 7 wherein said carrier comprises means for moving said flexible strip in a direction transverse to the direction of said elongate element.

9. A slingshot according to claim 8 wherein said means for moving comprises a screw which extends through said carrier and has one end which engages said flexible strip.

10. A sight for a slingshot comprising an elongate element, a carrier mounted to said elongate element for movement therealong, and a sighting element for extending into a crotch of said slingshot and carried by said carrier, wherein said sighting element is flexible to permit it to move out of said crotch if struck by said projectile wherein said sighting element comprises a flexible strip attached at one end of said carrier, said carrier comprises means for moving said flexible strip in a direction transverse to the direction of said elongate element and said means for moving comprises a screw which extends through said carrier and has one end which engages said flexible strip.

* * * * *